US005347739A

United States Patent [19]

Stuart

[11] Patent Number: 5,347,739

[45] Date of Patent: Sep. 20, 1994

[54] SAFETY CARTRIDGE

[75] Inventor: John C. Stuart, Peoria, Ariz.

[73] Assignee: Edward J. Krolak, Phoenix, Ariz.

[21] Appl. No.: 981,870

[22] Filed: Nov. 25, 1992

[51] Int. Cl.[5] ..... F41A 17/44

[52] U.S. Cl. ..... 42/70.11; 102/502

[58] Field of Search ..... 42/70.11, 70.01; 102/444, 446, 447, 529, 502

[56] References Cited

U.S. PATENT DOCUMENTS

| | | | |
|---|---|---|---|
| 1,285,287 | 11/1918 | McDaniel | 102/529 |
| 3,027,674 | 4/1962 | Mahan | 42/70.11 |
| 3,208,176 | 9/1965 | Giles | 42/70.11 |
| 3,249,048 | 5/1966 | Kerr | 102/447 |
| 3,360,880 | 1/1968 | Finnegan | 42/70.11 |
| 5,014,457 | 5/1991 | Lewis et al. | 42/70.11 |

*Primary Examiner*—David H. Brown
*Attorney, Agent, or Firm*—Tod R. Nissle

[57] ABSTRACT

A firearm safety cartridge lodges a projectile in the breech end of the barrel of the firearm to prevent live ammunition from being inserted into the firing chamber of the firearm.

4 Claims, 2 Drawing Sheets

FIG. 1
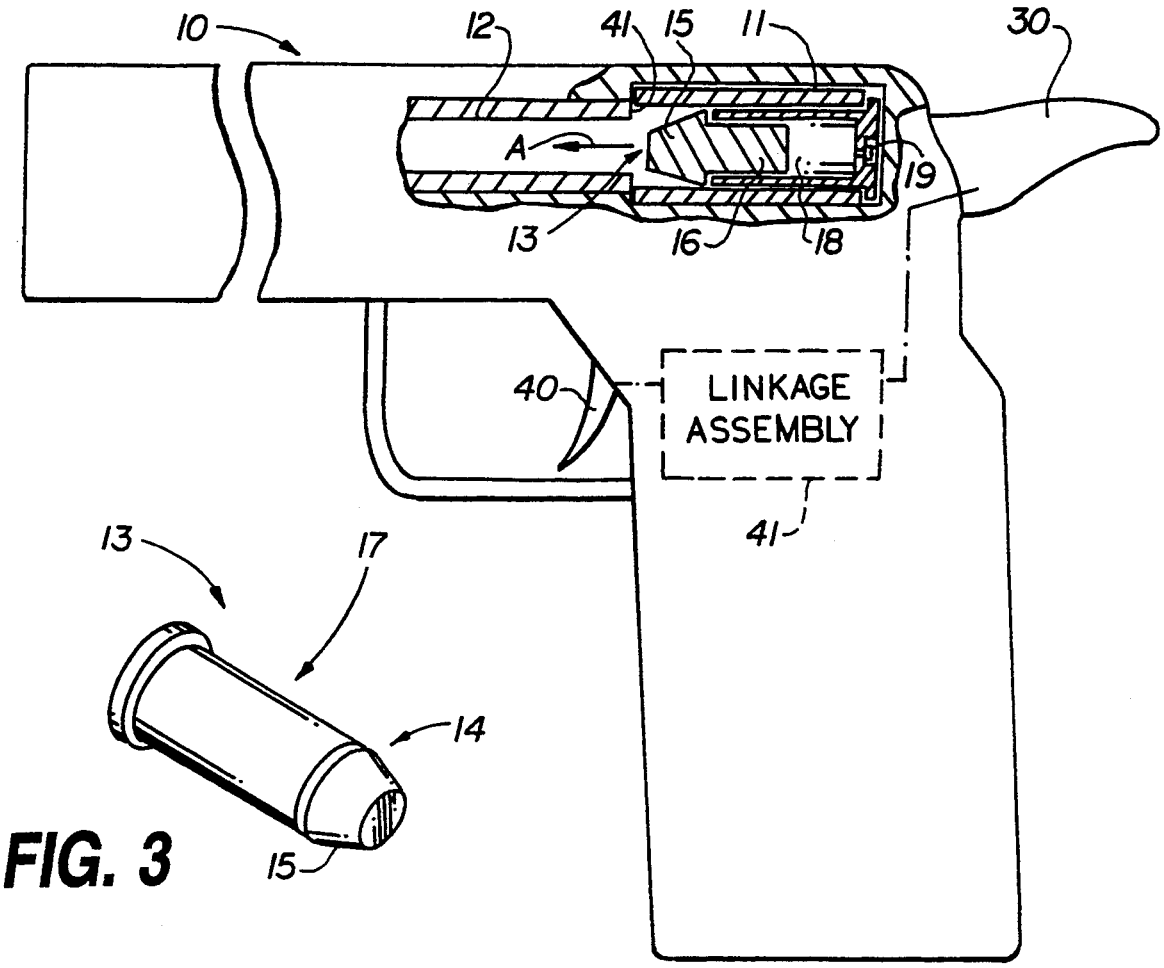
FIG. 3
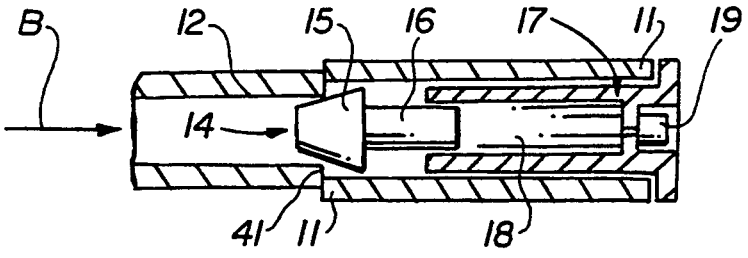
FIG. 2

FIG. 4
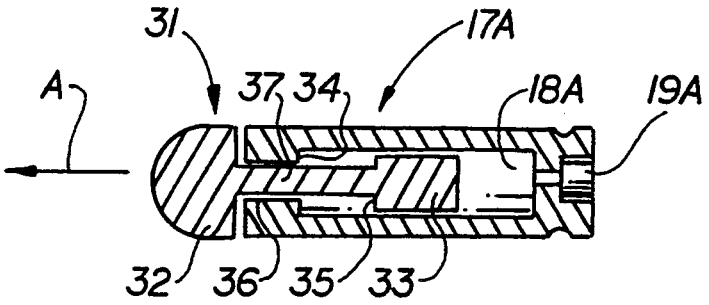
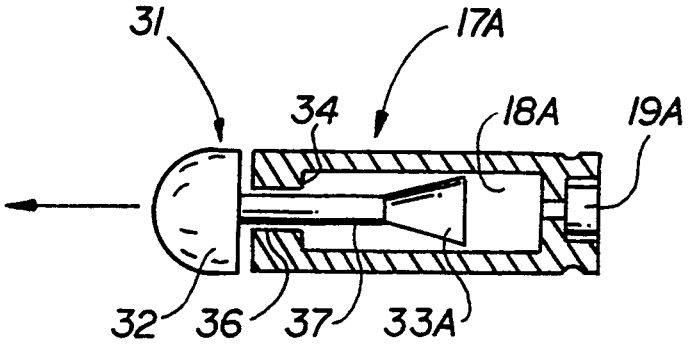
FIG. 5

SAFETY CARTRIDGE

This invention relates to a safety device for a firearm.

More particularly, the invention relates to a firearm safety cartridge which, when fired, lodges a projectile in the breech end of the barrel of the firearm to prevent live ammunition from being inserted in the firing chamber of the firearm.

In another respect, the invention relates to a firearm safety cartridge which lodges a projectile in the breech end of the barrel of the firearm without damaging the barrel.

In a further respect,the invention relates to a firearm safety cartridge which duplicates the appearance of live ammunition and which is readily inserted in the firing chamber of the firearm.

Each year, the accidental discharge of firearms results in serious bodily injury to many people. Even an unloaded firearms cause accidents because children locate the firearm, locate a round of live ammunition, load the round of ammunition into the firing chamber of the firearm, and activate the firing mechanism to discharge the firearm.

Therefore, it would be highly desirable to provide a safety device for a firearm which would significantly reduce the risk that live ammunition could be accidentally discharged in the firearm.

Accordingly, it is a principal object of the invention to provide a safety device for a firearm which prevents the accidental discharge of live ammunition in the firearm.

Another object of the invention is to provide a firearm safety device of the type described which can be readily inserted in and removed from a firearm by an adult but which is difficult for children, particularly young children, to remove from a firearm.

A further object of the invention is to provide a firearm safety device of the type described which will not score or damage either the inner surface of the barrel of the firearm or the firing chamber.

Still another object of the invention is to provide a firearm safety device which is activated when the firing mechanism of a firearm is operated.

These and other, further and more specific objects and advantages of the invention will be apparent to those skilled in the art from the following detailed description thereof, taken in conjunction with the drawings, in which:

FIG. 1 is a partial section view illustrating a firearm provided with a safety cartridge constructed in accordance with the principles of the invention;

FIG. 2 is a partial section view of the safety cartridge of FIG. 1 illustrating the mode of operation thereof;

FIG. 3 is a perspective view illustrating the safety cartridge of FIG. 1;

FIG. 4 is a side section view illustrating an alternate embodiment of the safety cartridge of the invention; and, FIG. 5 is a side section view illustrating still another embodiment of the safety cartridge of the invention.

Briefly, in accordance with my invention, I provide a safety cartridge for a firearm. The firearm includes a barrel having a breech end; a firing chamber adjacent the breech end of the barrel and in alignment with the barrel; and, a firing mechanism. The safety cartridge is shaped and dimensioned to be inserted in the firing chamber of the firearm and includes a cartridge case; propellant means mounted in the cartridge case to be ignited by the firing mechanism to form gas in the cartridge case; and, a projectile mounted in the cartridge case and shaped and dimensioned to be propelled toward and wedge in the breech end of the barrel when the safety cartridge is in the firing chamber and the propellant means is ignited by the firing mechanism.

In another embodiment of the invention, I provide a safety cartridge in combination with a firearm. The firearm includes a barrel having a breech end; a firing chamber adjacent the breech end of the barrel and in alignment with the barrel; and, a firing mechanism. The safety cartridge is shaped and dimensioned to be inserted in the firing chamber of the firearm and includes a cartridge case; propellant means mounted in the cartridge case to be activated by the firing mechanism; and, a projectile mounted in the cartridge case and shaped and dimensioned to be propelled toward and wedge in the breech end of the barrel when the safety cartridge is in the firing chamber and the propellant means is activated.

In still another embodiment of my invention, I provide a safety cartridge for a firearm. The firearm includes a barrel having a breech end; a firing chamber adjacent the breech end of the barrel and in alignment with the barrel; and, a firing mechanism. The safety cartridge is shaped and dimensioned to be inserted in the firing chamber of the firearm and includes a cartridge case; propellant means mounted in the cartridge case to be activated by the firing mechanism; and, a projectile housed in the cartridge case to be propelled toward the breech end of the barrel when the propellant means is activated. The projectile includes a proximate end and a distal end. The projectile and cartridge case are shaped and dimensioned such that when the safety cartridge is in the firing chamber and the propellant means is activated by the firing mechanism, the distal end is displaced away from the cartridge case a selected distance into the breech end of the barrel, and the proximate end remains adjacent a portion of the cartridge case after the distal end is displaced away from the cartridge case into the barrel.

Turning now to the drawings, which depict the presently preferred embodiments of the invention for the purpose of illustrating the practice thereof, and not by way of limitation of the scope of the invention, and in which like reference characters refer to corresponding elements throughout the several views, FIG. 1 illustrates a safety cartridge 13 constructed in accordance with the principles of the invention and in the firing chamber 11 of a firearm 10. The firing chamber 11 is aligned with cylindrical barrel 12 and is adjacent the breech end 41 of barrel 12. The firing mechanism of the firearm includes hammer 30 operated by the trigger 40. "Trigger 40 and hammer 30 are interconnected by a conventional linkage assembly, indicated by dashed lines 41 in FIG. 1, which operates hammer 30 when trigger 40 is depressed." The safety cartridge 13 is shaped to be inserted in the firing chamber 11 and includes a hollow cylindrical cartridge case 17 and a projectile 14 mounted in the case 17. Primer 19 is mounted in one end of case 17 and is in communication with hollow cylindrical chamber 18 of case 17. Gun powder can, if desired, be inserted in chamber 18 adjacent primer 19. Projectile 14 includes truncated conical head 15 attached to elongate cylindrical neck 16 slidably received by chamber 18. FIG. 3 illustrates safety cartridge 13 before cartridge 13 is inserted in chamber 11 and fired.

In use, cartridge 13 is loaded in the firing chamber 11 in the manner illustrated in FIG. 1. The trigger 40 is used to operate hammer 30 in conventional fashion to strike and ignite primer 19 and, if appropriate, to ignite gun powder in chamber 18. When primer 19 and the gun powder ignite, gas is generated which propels projectile in the direction of arrow A in FIG. 1, causing neck 16 to slide along chamber 18 and head 15 to enter end 41 of barrel 12. Conical head 15 is sized such that it lodges and wedges in the breech end 41 of barrel 12 in the manner illustrated in FIG. 2. Head 15 is preferably, but not necessarily, fabricated from a relatively soft resilient polymer or other material which does not damage barrel 12 when head 15 wedges in the breech end 41 of the barrel 12. When head 15 is wedged in end 41 in the manner illustrated in FIG. 2, it is difficult, at best, to remove safety cartridge 13 from firing chamber. In order to remove safety cartridge 13 from chamber 11 after the cartridge 13 has been fired, a rod is slid down barrel 12 in the direction of arrow B and pressed against head 15 to force it free from end 14 and cause neck 16 to slid along chamber 18 in the direction of arrow B toward the end of case 17 which housed the primer 19. After the rod has pushed head 15 in the direction of arrow B back against case 17 to the position shown in FIG. 1, the safety cartridge 13 can be removed from firearm 10. The safety cartridge 13 ordinarily will not be fired, but is instead simply loaded into and maintained in the firing chamber 11 of a firearm to protect against the inadvertent discharge of the firearm 10 by a youngster or adult.

An alternate embodiment of the invention is illustrated in FIG. 4 and comprises a cylindrical cartridge case 17A having a cylindrical hollow 18A. Primer 19A is mounted in one end of case 17A and is in communication with hollow 18A. Hollow 18A can, if desired, be charged with gun powder adjacent primer 19A. Projectile 31 includes a distal end 32 shaped to travel through barrel 12. End 32 is of a shape and size that is equivalent to the nose of a bullet found in a round of live ammunition normally used in firearm 10. Consequently, end 32 will freely travel through barrel 12. End 32 is connected to cylindrical neck 37 slidably extending through cylindrical aperture 36 formed in case 17A. Cylindrical piston 33 is connected to neck 37. Piston 33 can slidably move along hollow 18A. Piston 33 includes circular surface 35 which circumscribes neck 37. Case 17A includes circular surface 34 adjacent and circumscribing cylindrical aperture 36. FIG. 4 illustrates cartridge 17A prior to the cartridge 17A being fired. In use, the cartridge of FIG. 4 is loaded in the firing chamber of a firearm with end 32 adjacent the breech end of the barrel. The firing mechanism of the firearm is used to activate primer 19A and, if appropriate, gun powder in hollow 18A adjacent primer 19A. When primer 19A is activated, gas is generated in hollow 18A which propels projectile 31 in the direction of arrow A such that end 32 travels a selected distance into the breech end of the barrel of the firearm. The travel of projectile 31 in the direction of arrow A ceases when surface 35 contacts surface 34. When end 32 is extending into the breech end of the barrel of the firearm, removing the cartridge of FIG. 4 from the firearm is, at best, difficult. The cartridge is removed from the firearm by directing a rod through the open end of the barrel and against end 32 to cause projectile 31 to move in a direction of travel opposite that of arrow A and to slide piston 33 through hollow 18A to move projectile 31 back to the position illustrated in FIG. 4. Once the projectile 31 and case 17A are in the configuration of FIG. 4, the cartridge can be removed from the firing chamber of the firearm.

Still another alternate embodiment of the invention is illustrated in FIG. 5 and comprises a cylindrical cartridge case 17A having a cylindrical hollow 18A. Primer 19A is mounted in one end of case 17A and is in communication with hollow 18A. Hollow 18A can, if desired, be charged with gun powder adjacent primer 19A. Projectile 31 includes a distal end 32 shaped to travel through barrel 12. End 32 is of a shape and size that is equivalent to the nose of a bullet found in a round of live ammunition normally used in firearm 10. Consequently, end 32 will freely travel through barrel 12. End 32 is connected to cylindrical neck 37 slidably extending through cylindrical aperture 36 formed in case 17A. Conical piston 33A is connected to neck 37. Piston 33A can slidably move along hollow 18A. Case 17A includes circular surface 34 adjacent and circumscribing cylindrical aperture 36. FIG. 5 illustrates cartridge 17A prior to the cartridge 17A being fired. In use, the cartridge of FIG. 5 is loaded in the firing chamber of a firearm with the end 32 adjacent the breech end of the barrel, and the firing mechanism of the firearm is used to activate primer 19A and, if appropriate, gun powder in hollow 18A. When primer 19A is activated, gas is generated in hollow 18A which propels projectile 31 in the direction of arrow A such that end 32 travels a selected distance into the breech end of the barrel of the firearm. The travel of projectile 31 in the direction of arrow A ceases when conical piston 33A wedges in aperture 36 in the same manner that head 15 is wedged into end 41 in FIG. 2. When end 32 is in the breech end of the barrel of the firearm, removing the cartridge of FIG. 5 from the firearm is, at best, difficult. The cartridge is removed from the firearm by directing a rod through the open end of the barrel and against end 32 to cause projectile 31 to move in a direction of travel opposite that of arrow A and to slide piston 33A through hollow 18A to move projectile 31 back to the position illustrated in FIG. 5. Once the projectile 31 and case 17A have resumed the configuration of FIG. 5, the cartridge can be removed from the firing chamber of the firearm.

One advantage of the cartridges illustrated in FIGS. 4 and 5 is that they can be readily fabricated to duplicate the exterior shape and appearance of live ammunition which is normally utilized in a firearm.

The safety cartridges illustrated in FIGS. 1 to 5 utilize a primer and, if desired, gun powder to create gas in the cartridge case 17, 17A to propel the projectiles 14, 31, respectively, in a direction outwardly from the case into the breech end of the barrel of the firearm. Pressurized air or any other desired means can be used in place of or in conjunction with the primer and gun powder to propel the projectiles out of the cartridge case.

In the embodiments of the invention illustrated in FIGS. 1 to 5, pistons 33 and 33A and neck 16 slide along a cylindrical hollow in the cartridge case. As would be appreciated by those of skill in the art, a hollow cylindrical sleeve can be substituted for neck 16 and attached to head 15 in the safety cartridge of FIG. 1. The cylindrical sleeve is attached to head 15 and slidably extends over the cylindrical outer surface of the cartridge case 17. When primer 19 is ignited, the cylindrical sleeve slides over case 17 in the direction of arrow A at the same time head 15 moves in the direction of arrow A.

Consequently, the constructing a safety cartridge 13, the cartridge case 17 and projectile 14 can have any shape and dimension provided that the cartridge 13 fits in firing chamber 11, and that head 15 can be displaced a selected distance into the breech end 41 while a neck 16 or other member which is connected to head 15 still extends into or over a portion of case 17.

Having described my invention in such terms as to enable those of skill in the art to understand and practice it, and having identified the presently preferred embodiments thereof, I claim:

1. A safety cartridge for a firearm including
a barrel having a breech end,
a firing chamber adjacent the breech end of the barrel and in alignment with the barrel, and
a firing mechanism,
said cartridge being shaped and dimensioned to be inserted in the firing chamber of the firearm and including
(a) a cartridge case;
(b) propellant means mounted in said cartridge case to be ignited by said firing mechanism to form gas in the cartridge case;
(c) a projectile mounted in the cartridge case and being shaped and dimensioned to be propelled toward and wedge in the breech end of the barrel when said cartridge is in the firing chamber and the propellant means is ignited by the firing mechanism.

2. In combination with a firearm including
a barrel having a breech end,
a firing chamber adjacent the breech end of the barrel and in alignment with the barrel,
a firing mechanism,
the improvement comprising a safety cartridge, said cartridge being shaped and dimensioned to be inserted in the firing chamber of the firearm and including
(a) a cartridge case;
(b) propellant means mounted in said cartridge case to be activated by said firing mechanism;
(c) a projectile mounted in the cartridge case and shaped and dimensioned to be propelled toward and wedge in the breech end of the barrel when said cartridge is in the firing chamber and said propellant means is activated by the firing mechanism.

3. A safety cartridge for a firearm including
a barrel having a breech end,
a firing chamber adjacent the breech end of the barrel and in alignment with the barrel,
a firing mechanism,
said cartridge being shaped and dimensioned to be inserted in the firing chamber of the firearm and including
(a) a cartridge case;
(b) propellant means mounted in said cartridge case to be activated by said firing mechanism;
(c) a projectile housed in the cartridge case to be propelled toward the breech end of the barrel when the propellant means is activated, said projectile including a proximate end and a distal end;
said projectile and cartridge case being shaped and dimensioned such that when said cartridge is in the firing chamber and said propellant means is activated by the firing mechanism,
said distal end is displaced away from said cartridge case a selected distance into the breech end of the barrel, and
said proximate end remains adjacent a portion of said cartridge case after said distal end is displaced away from said cartridge case said selected distance into the barrel.

4. The safety cartridge of claim 3 wherein said proximate end is shaped and dimensioned to wedge in said cartridge case after said distal end is displaced away from said cartridge case said selected distance into the barrel.

* * * * *